US007165406B2

(12) United States Patent
Longsworth

(10) Patent No.: US 7,165,406 B2
(45) Date of Patent: Jan. 23, 2007

(54) INTEGRAL PULSE TUBE REFRIGERATOR AND CRYOPUMP

(75) Inventor: Ralph C. Longsworth, Allentown, PA (US)

(73) Assignee: SHI-APD Cryogenics, Inc., Allentown, PA (US)

( * ) Notice: Subject to any disclaimer, the term of this patent is extended or adjusted under 35 U.S.C. 154(b) by 378 days.

(21) Appl. No.: 10/500,783

(22) PCT Filed: Jan. 8, 2003

(86) PCT No.: PCT/US03/00389

§ 371 (c)(1),
(2), (4) Date: Jul. 2, 2004

(87) PCT Pub. No.: WO03/060391

PCT Pub. Date: Jul. 24, 2003

(65) Prior Publication Data

US 2004/0261423 A1 Dec. 30, 2004

Related U.S. Application Data

(60) Provisional application No. 60/346,676, filed on Jan. 8, 2002.

(51) Int. Cl.
*F25B 9/00* (2006.01)
*B01D 8/00* (2006.01)

(52) U.S. Cl. ..... 62/6; 62/55.5

(58) Field of Classification Search ..... 62/6, 62/55.5

See application file for complete search history.

(56) References Cited

U.S. PATENT DOCUMENTS

| | | | | |
|---|---|---|---|---|
| 5,443,548 | A | 8/1995 | Saho et al. | |
| 5,845,498 | A | 12/1998 | Matsui et al. | |
| 5,974,807 | A | 11/1999 | Gao et al. | |
| 6,263,677 | B1 | 7/2001 | Hafner et al. | |
| 6,293,109 | B1 | 9/2001 | Miyamoto | |
| 2005/0000232 | A1* | 1/2005 | Longsworth | 62/6 |
| 2005/0011200 | A1* | 1/2005 | Longsworth | 62/6 |
| 2006/0026968 | A1* | 2/2006 | Gao | 62/6 |

FOREIGN PATENT DOCUMENTS

| | | |
|---|---|---|
| JP | 10-184540 | 7/1998 |

* cited by examiner

*Primary Examiner*—William C Doerrler
(74) *Attorney, Agent, or Firm*—Katten Muchin Rosenman LLP

(57) ABSTRACT

An integrated cryopump and 2 stage pulse tube refrigeration system (100) comprising a cryopump, a compressor for a pulse tube refrigerator, a pulse tube refrigerator located within the vacuum chamber of the cryopump where the hot ends of the pulse tubes (165,175) are connected to each other through a buffer volume (180), are integral to the cryopump vacuum chamber hosing, and a buffer volume (180) is connected to the hot ends (117,119) of the pulse tubes (165,175) through flow restrictors (145,150).

17 Claims, 7 Drawing Sheets

INTEGRAL PULSE TUBE REFRIGERATOR AND CRYOPUMP

This application is the National Stage of International Application No. PCT/US03/00389, filed Jan. 8, 2003, which claims the benefit under 35 U.S.C. 119(e) of U.S. Provisional Application No. 60/346,676, filed Jan. 8, 2002.

BACKGROUND OF THE INVENTION

The Gifford-McMahon (G-M) type pulse tube refrigerator is a cryocooler, similar G-M refrigerators, that derives cooling from the compression and expansion of gas. However, unlike the G-M systems, in which the gas expansion work is transferred out of the expansion space by a solid expansion piston or displacer, pulse tube refrigerators have no moving parts in their cold end, but rather an oscillating gas column within the pulse tube (called a gas piston) that functions as a compressible displacer. The elimination of moving parts in the cold end of pulse tube refrigerators allows a significant reduction of vibration, as well as greater reliability and lifetime, and is thus potentially very useful in cooling cryopumps to 10 K.

G-M type pulse tube refrigerators are characterized by having a compressor that is connected to a remote expander by high and low pressure gas lines. The expander has a valve mechanism that alternately pressurizes and depressurizes the regenerators and pulse tubes to produce refrigeration at cryogenic temperatures.

G-M type pulse tube refrigerators that operate below 20 K have the disadvantage of requiring that the hot end of the pulse tube be above the cold end in order to avoid the thermal losses associated with convective circulation within the pulse tube. Conventional two-stage GM type pulse tube refrigerators typically have the valve mechanism and the hot end of the pulse tube on top. This enables the heat that is rejected at the hot end of the pulse tube to be easily transferred to the low-pressure gas and returned to the compressor where it is rejected. Conventional two stage pulse tube refrigerators also require a relatively large buffer volume(s). Two stage G-M refrigerators, which are presently being used to cool cryopumps, require no buffer volume and can be mounted in any orientation.

Most cryopumps are mounted below the vacuum chamber where space above the cryopump housing is very limited. Having the valve mechanism above the cryopump housing limits the applications of the cryopump. Thus, any options to orient the pulse tube refrigerator with the valve behind or below a cryopump housing that has a side inlet are highly desirable. Minimizing the size of the buffer volumes is also desirable.

Separating the hot end of the pulse tube from the valve introduces the problem of removing the heat that has to be rejected at the hot end of the pulse tube. From the standpoint of assembling a pulse tube refrigerator it is attractive to be able to remove the pulse tube assembly from the cryopump housing. Having the hot end of the pulse tube in vacuum and isolated from the cryopump housing makes the problem of cooling the hot end more difficult than if it is attached to the housing.

C. K. Chan, C. B. Jaco, J. Raab, E. Tward, and M. Waterman, in a paper titled "Miniature pulse tube cooler", Proc. 7th Int'l Cryocooler Conf., Air Force Report PL-CP—93-1001 (1993) pp. 113–124, describe a Stirling single stage pulse tube that is inline, thus the hot end of the pulse tube is remote from the regenerator inlet. It has double orifice control. Heat from the hot end of the pulse tube and buffer are rejected to the base at the regenerator inlet by conduction through the buffer housing which extends the full length of the pulse tube. The hot end of the pulse tube is not attached to the vacuum housing so the entire pulse tube assembly can be easily removed.

Another method of removing heat from an inline pulse tube that is removable from a cryopump housing directs gas that is returning to the compressor to the hot end of the pulse tube where it picks up heat and transports it to the compressor to be rejected.

Gao et al., U.S. Pat. No. 5,974,807, dated Nov. 2, 1999 and entitled "Pulse Tube Refrigerator," describes a pulse tube refrigerator capable of generating cryogenic temperatures of below 10 K that includes first and second refrigeration stages. Each stage includes a pulse tube and an associated regenerator provided at the low temperature side of the pulse tube. The high temperature ends of each pulse tube are connected by a continuous channel, while the high temperature ends of each pulse tube and the high temperature ends of each regenerator are connected by a by-pass channel. When pressure fluctuation is generated in each pulse tube at the phase difference angle of 180 degrees, respectively, a working gas is transferred between the high temperature ends of each pulse tube as controlled by an active valve, and between the high temperature ends of each pulse tube and its associated regenerator as controlled by a passive valve.

The technology disclosed by Gao et al., may be attractive for application in cryopumps because it requires no buffer volume.

Matsui et al., U.S. Pat. No. 5,845,498, dated Nov. 2, 1999 and entitled "Pulse Tube Refrigerator," discusses the problems associated with applying prior art pulse tubes to applications where the inlet needs to be at the bottom. This patent teaches a solution to keeping the hot ends of the pulse tubes on top by using extended lengths of piping to connect components in a conventional arrangement. The volume associated with the extended tubes and the temperature patterns caused by pulse tube effects detract from the performance of this type of pulse tube.

Kawano, S. et al., U.S. Pat. No. 6,196,006, dated Mar. 6, 2001 and entitled "Pulse Tube Refrigerator" describes a pulse tube refrigerator with all of the warm gas connections being on the side of a base at ambient temperature. The regenerator is above the base; cold end on top, and the pulse tube is below the base, with the hot end fixed in the base. A long tube connects the cold end of the regenerator to the cold end of the pulse tube.

Chan, C. K. and Tward, E., U.S. Pat. No. 5,107,683, dated Apr. 28, 1992 and entitled "Multistage Pulse Tube Cooler," describes a multistage pulse tube cooler in which a portion of the heat from each successively lower-temperature pulse tube cooler is rejected to a heat sink other than the preceding higher-temperature pulse tube cooler. This is done by having the second (and possibly third) stage pulse tube(s) reject heat at ambient temperature. This patent shows a two-stage pulse tube, each pulse tube having a single orifice and buffer volume, with the inlet to the warm regenerator at the bottom, and the hot ends of the pulse tubes on top. Furthermore the regenerators, pulse tube, and hot end heat stations are all in the vacuum space. Only the connections to the buffer tanks and the inlet tube extend through the vacuum boundary. The patent does not teach how the heat is removed from the hot end heat exchangers but the inventor's paper mentioned above describes a thermal conduction path back to the base.

Miyamoto, A. et. Al., U.S. Pat. No. 6,293,109, dated Sep. 25, 2001 and entitled "Pulse Pipe Refrigerating Machine And Cryopump Using The Same" describes a single stage pulse tube with the inlet to the regenerator at the bottom and the pulse tube oriented cold end up. The single cryopanel is a cup that is open on top. The essential teaching of this patent is the use of a working gas that at least partially condenses in the working temperature range of the cryopump. Examples are given for temperatures between 99 K and 115 K. It is known from this and other studies that the convective losses in pulse tubes when the hot end is oriented on the side or bottom become more significant as the cold station temperature is reduced below about 80 K.

The present invention optionally incorporates a number of different control concepts that have been described previously. Zhu, S. and Wu, P., "Double inlet pulse tube refrigerators: an important improvement", Cryogenics, vol. 30 (1990), p. 514 describes the use of the second orifice and how it improves the performance of a single orifice pulse tube. A. Watanabe, G. W. Swift, and J. G. Brisson, "Superfluid orifice pulse tube below 1 K", Advances in Cryogenic Engineering, Vol. 41B, pp. 1519–1526 (1996) describe interphase control. It discusses a very low temperature Stirling cycle cooler that has one passive orifice between two identical pulse tubes. J. L. Gao and Y. Matsubara, "An inter-phasing pulse tube refrigerator for high refrigeration efficiency", in: Proceedings of the 16th International Cryogenic Engineering Conference, T. Haruyama, T. Mitsui and K. Yamafriji, ed., Eisevier Science, Oxford (1997), pp. 295–298 discuss identical dual 1, 2, and 3 stage pulse tubes with single active interconnect valves.

It is an object of this invention to provide an improved means of mounting a two-stage pulse tube refrigerator in a cryopump housing that has a side inlet.

It is another object to simplify construction of pulse tube refrigerators.

It is yet another object to improve heat rejection from the hot ends of the pulse tubes, and provide pulse tube refrigerators where the valve mechanism is below or behind the cryopump housing.

SUMMARY

The present invention describes two-stage pulse tube refrigerator configurations that are an integral part of a cryopump housing which has a side inlet. The gas inlets to the regenerators are at the bottom or back of the cryopump housing which results in the hot end of at least the second stage pulse tube being remote from gas inlets. The objective of facilitating the removal of heat at the hot end of at least the second stage pulse tube is accomplished by having the pulse tube/regenerator assembly built as an integral part of the cryopump housing with the hot end of the pulse tube extending through the housing wall. This makes it practical to cool the hot end by several different methods including fins on the buffer tank cooled by air, cooling by circulation of gas from the compressor, circulation of gas flowing to the buffer tank, or cooling by conduction to the cryopump housing. Having the regenerators and pulse tubes as an integral part of the housing also provides more options in the way the regenerators and pulse tubes are mounted and the ways that phase shifting is accomplished, relative to pulse tubes that are removable.

DESCRIPTION OF THE INVENTION

Figure 1:
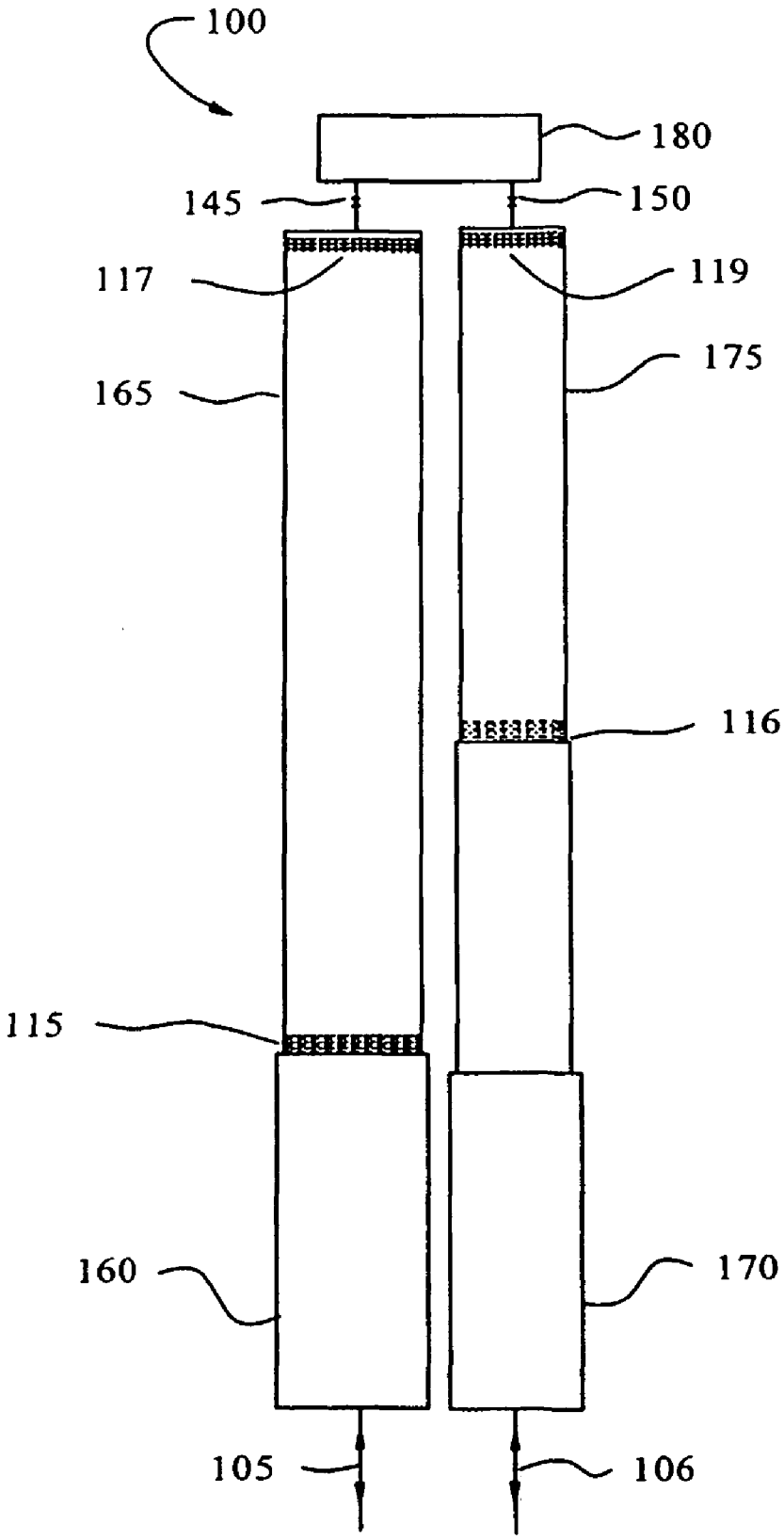
FIG. 1 is a schematic of a basic design for an inline two-stage pulse tube refrigerator, with interphase control and a small buffer tank.

FIG. 1 shows a schematic of pulse tube refrigerator 100, which is a basic inline two-stage pulse tube refrigerator that has interphase control and a buffer tank. This design is incorporated along with various options in embodiments one to five as shown in FIGS. 2 through 6. The first stage pulse tube assembly includes an inlet gas connection 105, a regenerator 160, a cold station 115, a pulse tube 165, a hot station 117, and a restrictor 145. The second stage pulse tube assembly includes an inlet gas connection 106, a regenerator 170, a cold station 116, a pulse tube 175, a hot station 119, and a restrictor 150. Gas is cycled through gas connections 105 and 106 into each of the two pulse tube assemblies 180° out of phase. Gas flows back and forth between the hot ends of the pulse tubes through restrictor 145, buffer tank 180, and restrictor 150. Buffer tank 180 is sized to make up for the difference in flow from each of the pulse tubes. The buffer tank is much smaller than for designs that have the pressure cycle in phase in each pulse tube.

Figure 2:
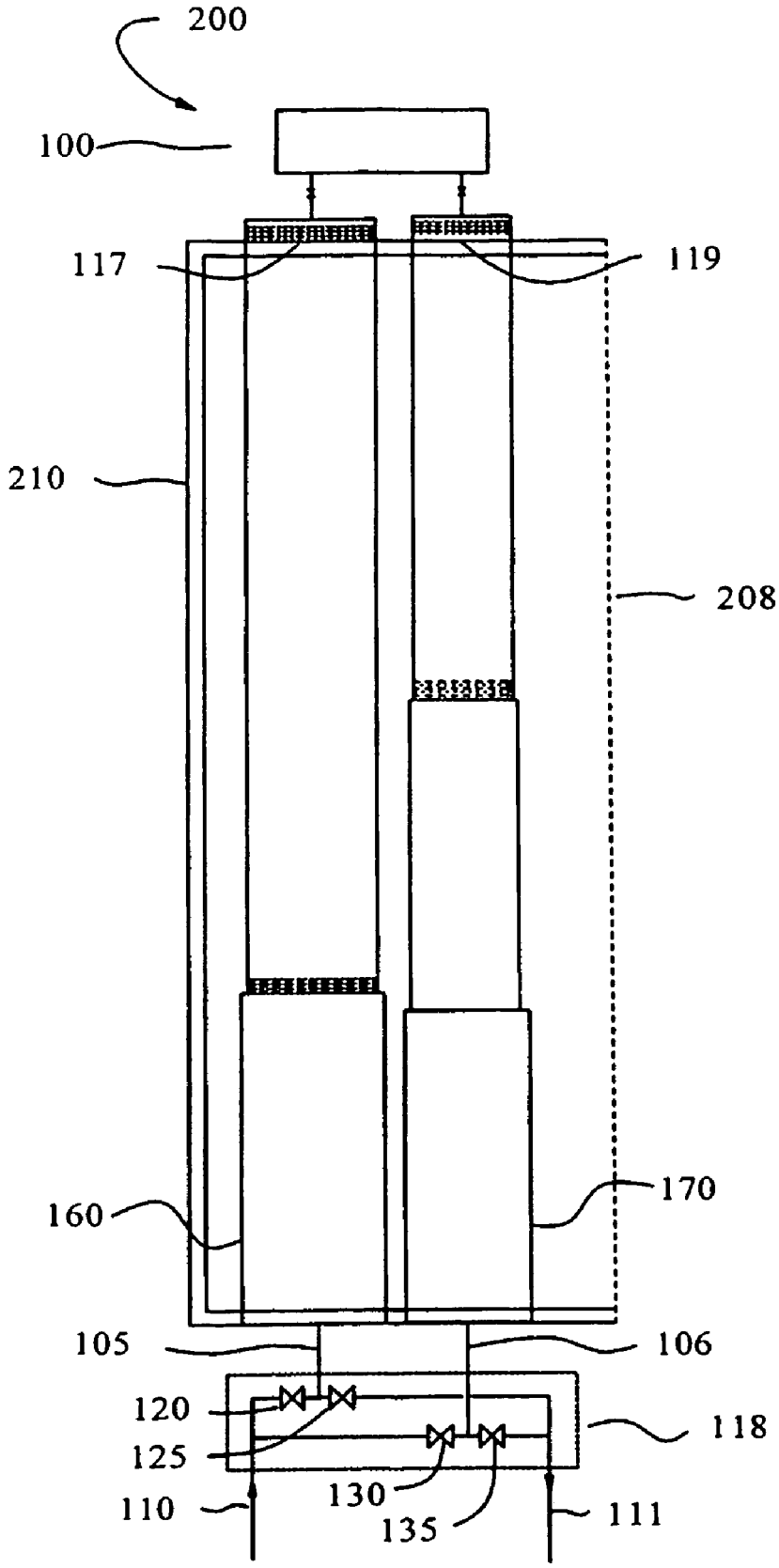
FIG. 2 is a schematic of an embodiment of the present invention showing a valve assembly and in which the refrigerator of FIG. 1 is integrated into the cryopump housing.

FIG. 2 shows a schematic of a first embodiment of the present invention, cryopump and pulse tube refrigerator 200, in which hot stations 117 and 119 of pulse tube refrigerator 100 are an integral part of the top of cryopump housing 210 and may extend through it. The gas connections to the buffer tank are preferably external to the vacuum space inside the housing. The warm ends of regenerators 160 and 170 are fixed in the bottom of cryopump housing 210. Gas connections 105 and 106 are external to the vacuum space and connect to valve assembly 118. Valve assembly 118 contains valves 120, and 130, which are connected to the high pressure line from the compressor (not shown) through gas inlet 110, valves 125 and 135, which are connected the low pressure line to the compressor through gas outlet 111. These valves alternately open and close to pressurize and depressurize the two pulse tubes out of phase with each other.

The valves are typically incorporated in a single rotary disc that cycles the gas at about 2 Hz. Helium is used as the working fluid for pulse tubes that operate below 20 K. Typical pressures are 300 psig (2.2 MPa) and 100 psig (0.8 MPa). Cryopumps typically operate at about 15 K at cold station 116 and 60 K at cold station 115. Regenerator 160 and the warm section of regenerator 170 are typically stainless steel tubes packed with Bronze screens and the cold section of regenerator 170 is typically packed with lead shot.

Pulse tubes 165 and 175 are typically made of stainless steel. The sizes of the components are dependent on the cooling capacities, temperatures, operating pressures, and pulse rates as determined by one skilled in the art.

The means of removing heat from the hot stations and the buffer tank are not shown but include conduction to the cryopump housing which may be made of aluminum, circulating air through fins on the components external to the cryopump housing, circulating gas from the compressor, or rectifying the pulsating flow from hot stations 117 and 119 so it can be circulated to cooling fins. A separate coolant, such as water, can also be used.

Figure 3:
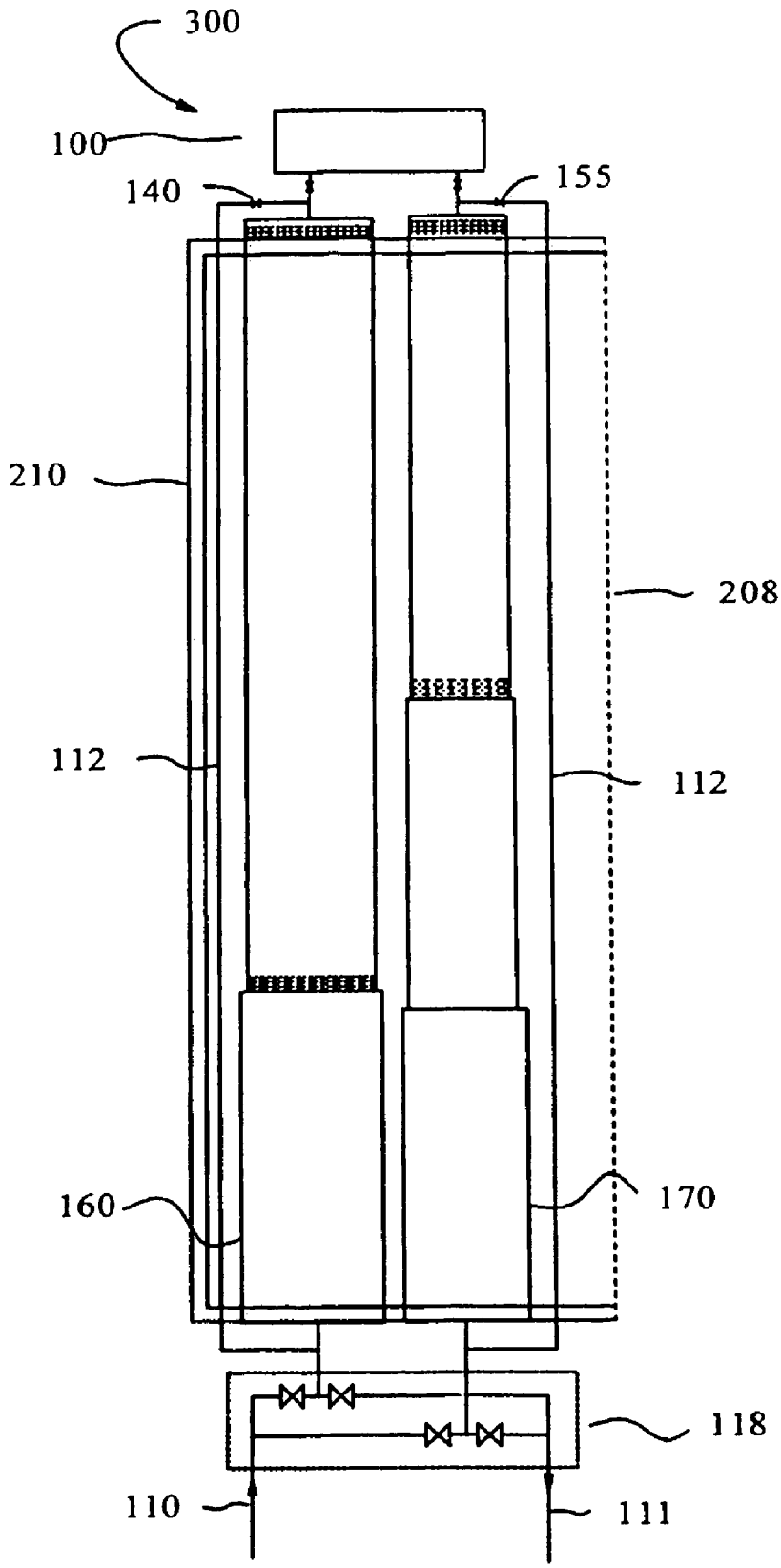
FIG. 3 is a schematic of an embodiment of the present invention having a first alternate phasing mechanism.

FIG. 3 shows a second embodiment, cryopump and pulse tube refrigerator 300, which differs from the first embodiment only by the addition of second restrictors and a bypass line. Bypass 112 extends from the inlet to regenerator 160 to the hot end of pulse tube 165, into buffer tank 180, out of buffer tank 180, to the hot end of pulse tube 175, and back to the warm end of regenerator 170. Flow restrictor 140 is between the inlet to regenerator 160 and the hot end of pulse tube 165, flow restrictor 145 is between the hot end of pulse tube 165 and buffer tank 180, flow restrictor 150 is between buffer tank 180 and the hot end of pulse tube 175, and flow restrictor 155 is between the hot end of pulse tube 175 and the warm end of regenerator 170. Bypass 112 can either be inside the vacuum space or external to it. The second restrictors and bypass line improve the phase shifting within the pulse tubes and increases the efficiency. All of the restrictors are passive devices such as needle valves, orifices, porous plugs, or restrictor tubes.

Figure 4:
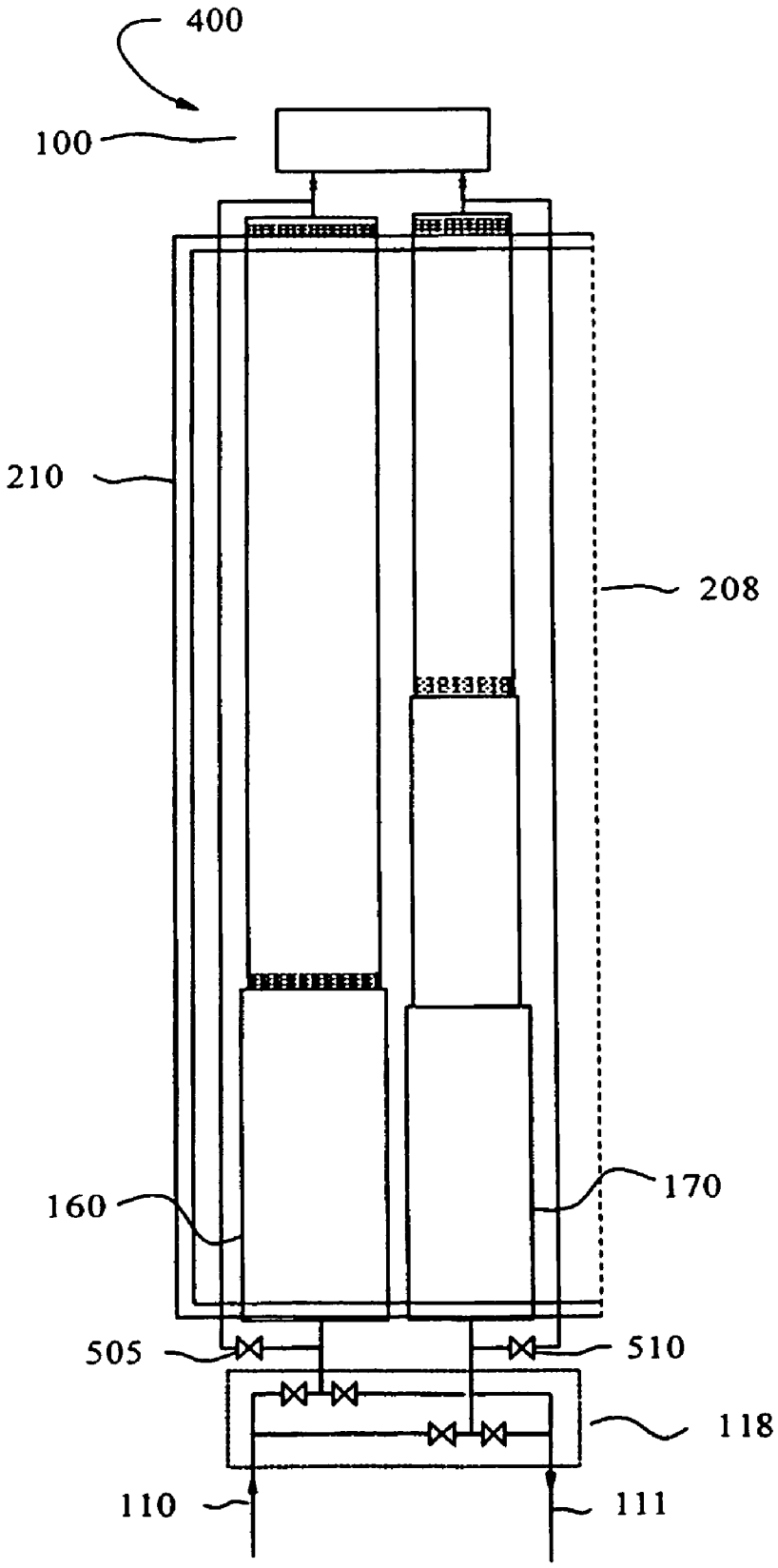
FIG. 4 is a schematic of an embodiment that incorporates a second alternate phasing mechanism.

FIG. 4 shows a third embodiment, cryopump and pulse tube 400, which differs from the second embodiment only by the substitution of active valves for passive restrictors in the bypass lines from warm ends of the regenerators. Restrictor 140 is replaced by valve 505, and restrictor 155 is replaced by valve 510. Having active valves in the bypass lines gives better control of the phase shifting but it comes at the expense of additional complexity. Active valves 505 and 510 would typically be incorporated in the same rotary disc as the other active valves in valve assembly 118.

Figure 5:
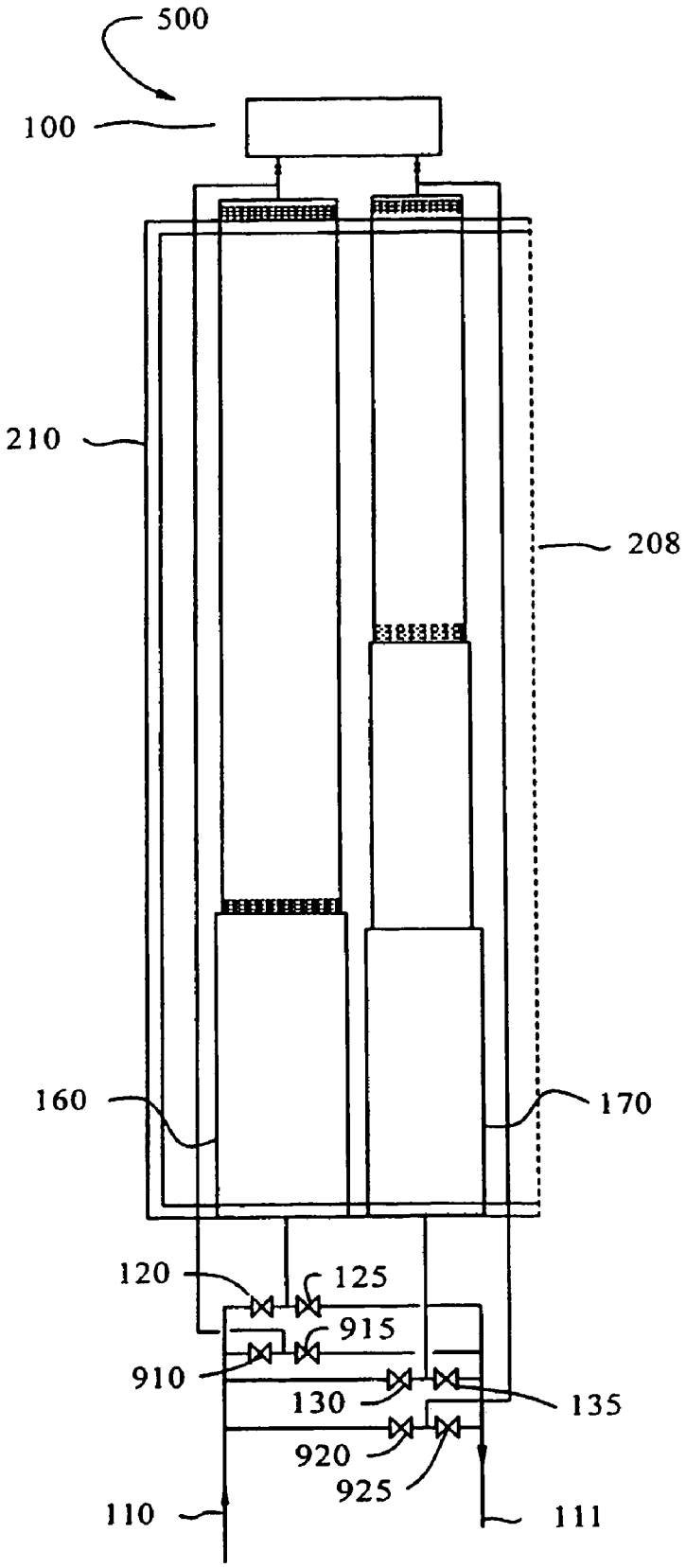
FIG. 5 is a schematic of an embodiment that incorporates a third alternate phasing mechanism.

FIG. 5 shows a fourth embodiment, cryopump and pulse tube refrigerator 500, which differs from the third embodiment by having the bypass lines connected directly to the compressor through active valves. Valve 910 connects high-pressure gas to the hot end of pulse tube 165, and valve 915 controls the return of the gas from the hot end of pulse tube 165 to the low-pressure line to the compressor. Valve 920 connects high-pressure gas to the hot end of pulse tube 175, and valve 925 controls the return of the gas from the hot end of pulse tube 175 to the low-pressure line to the compressor. Active valves 910, 915, 920 and 925 are typically incorporated in the same rotary disc as the other active valves in valve assembly 118.

Figure 6:
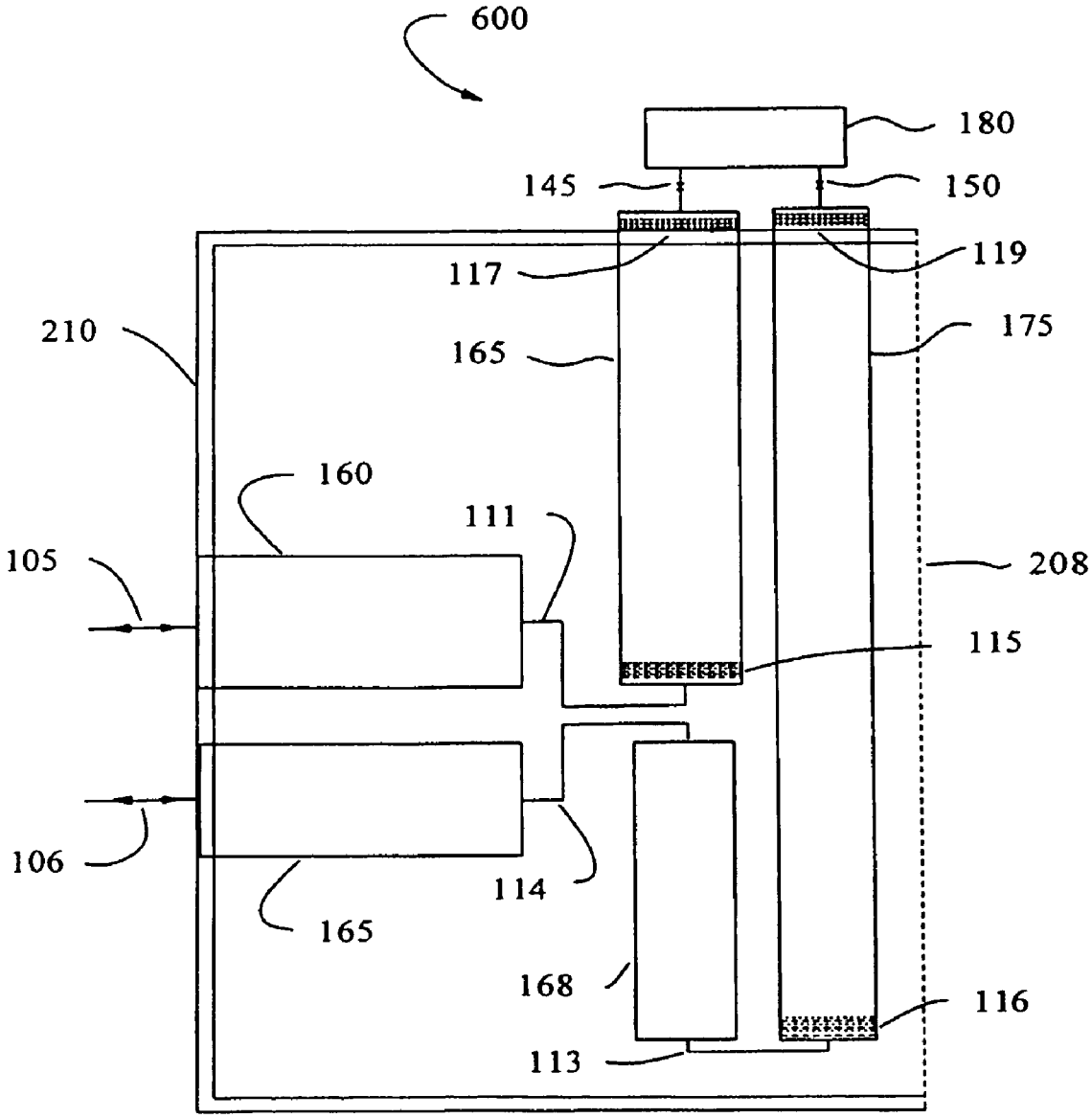
FIG. 6 is a schematic of an embodiment of the present invention in which the refrigerator of FIG. 1 is integrated into the cryopump housing in such a way that the inlet gas lines to the warm ends of the regenerators come in the back of the cryopump housing.

FIG. 6 shows a schematic of a fifth embodiment of the present invention, cryopump and pulse tube refrigerator 500, in which the components of pulse tube refrigerator 100 are arranged as an integral part of cryopump housing 210 in a way that is not possible for a removable pulse tube refrigerator. Hot stations 117 and 119 of the two-stage pulse tube refrigerator are an integral part of the top of cryopump housing 210 and may extend through it. The gas connections to the buffer tank are preferably external to the vacuum space. The warm ends of regenerators 160 and 165 are fixed in the back of cryopump housing 210, opposite cryopump inlet 208. Gas connections 105 and 106 are external to the vacuum space. This arrangement has regenerator 160 and regenerator 165 mounted horizontally.

Piping 111 connects the cold end of regenerator 160 to the cold end of pulse tube 165. In the present design, the second stage regenerator [shown as regenerator 170 in FIG. 1] is divided into a warmer section, regenerator 165, and a colder section, regenerator 168, connected by piping 114. Piping 113 connects the cold end of regenerator 168 and the cold end of pulse tube 175.

A valve assembly, such as shown in FIG. 2, would be mounted on the back of cryopump housing 210. Cryopump and pulse tube refrigerator 600 thus have a very low height from the bottom of the cryopump housing to the top of the components that extend above the housing.

The alternate phase shifting arrangements shown in FIGS. 3, 4, and 5, can be applied equally well for the fifth embodiment.

Figure 7:
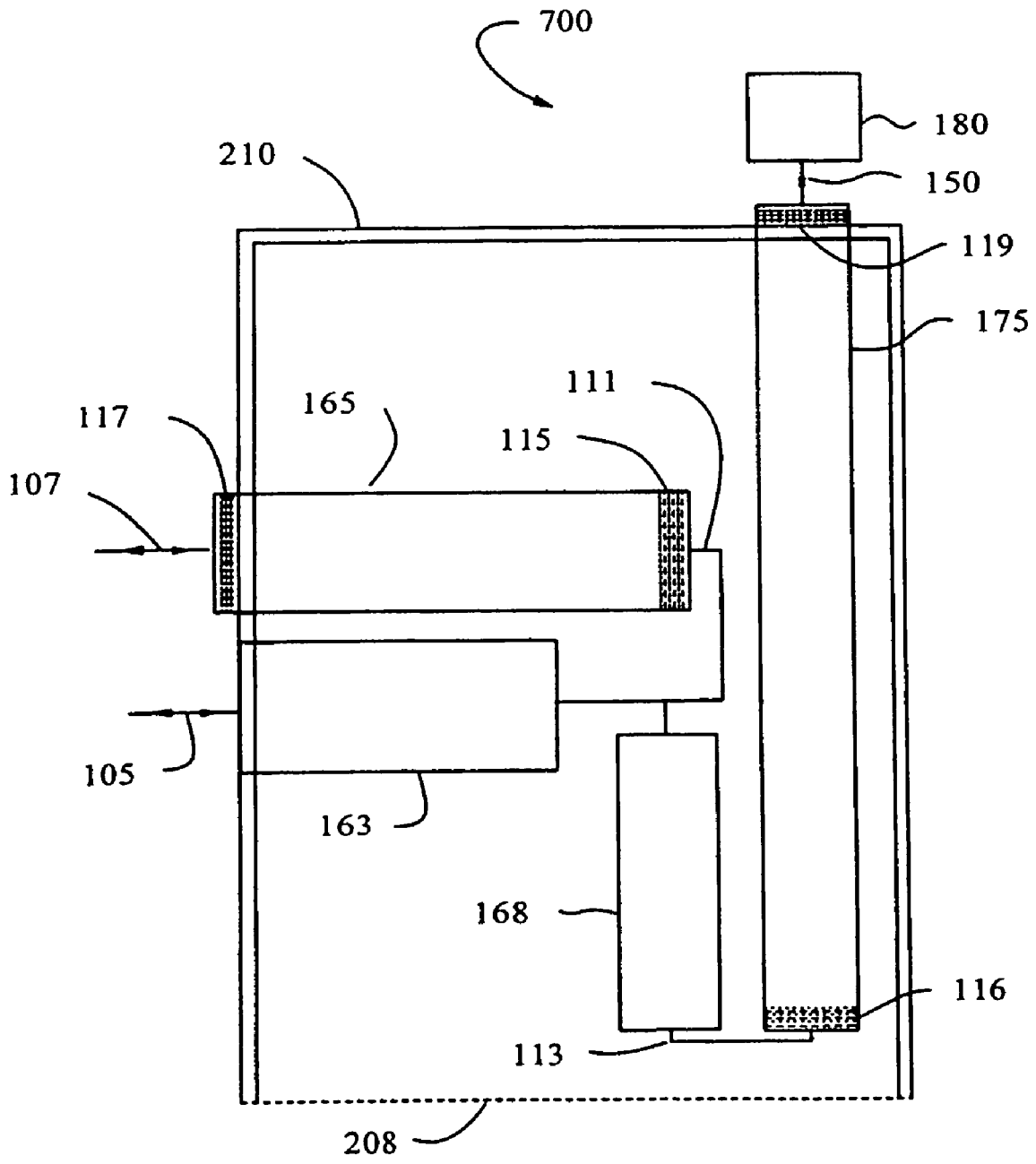
FIG. 7 is a schematic of an embodiment of the present invention in which a two stage pulse tube refrigerator with a single warm regenerator and a single inlet line is integrated into the cryopump housing in such a way that the first stage pulse tube is horizontal.

FIG. 7 shows a schematic of a sixth embodiment of the present invention, cryopump and pulse tube refrigerator 600, which further illustrates the flexibility that is available in designing a pulse tube refrigerator for a cryopump when it is an integral part of the cryopump housing. In this embodiment second stage pulse tube 175 is oriented with the hot end up and hot station 119 extending through the top of cryopump housing 210. First stage pulse tube 165 differs from previous arrangements in that it is oriented horizontally, with the hot end and hot station 117 extending through the back of cryopump housing 210. Gas connection 107 from the hot end of pulse tube 165 can be part of the valve assembly that controls the flow of gas through gas connection 105 and incorporate a number of different phase shifting mechanisms as are well known by those skilled in the art Connecting the hot end of pulse tube 165 to the valve assembly also offers other options to remove heat and connect a buffer volume. The arrangement shown in the sixth embodiment has a common warm regenerator for the first and second stages, regenerator 163. Piping 111 connects the cold end of regenerator 163 to the cold end of pulse tube 165 and the warm end of regenerator 168. Piping 113 connects the cold end of regenerator 168 with the cold end of pulse tube 175.

Having a common warm regenerator means that the pressure in both pulse tubes cycles in phase. In a typical cryopump the amount of heat rejected from the first stage is more than twice as much as the second stage. Also the volume of gas flowing from the hot end of the first stage pulse tube is about twice as much as from the hot end of the second stage. The net result is that the buffer tank 180 is about the same size for the second stage by itself as the buffer tank that is needed to accommodate the difference in gas flow for the interphase control of pulse tube refrigerator 100. Embodiment six thus has about the same buffer volume on the top of the cryopump housing but only about a third of the heat dissipation.

The invention claimed is:

1. An integrated cryopump and 2 stage pulse tube refrigeration system comprising a cryopump, a compressor for a pulse tube refrigerator, a pulse tube refrigerator located within the vacuum chamber of the cryopump where the refrigerator comprises first and second stage regenerators connected to the compressor via a valve assembly external to the cryopump vacuum chamber at one end and connected to the cold station of first and second stage pulse tubes, respectively, at the other end, and the hot ends of the pulse tubes are connected to each other through a buffer volume, the hot ends of the pulse tubes are integral to the cryopump vacuum chamber housing, and a buffer volume is connected to the hot ends of the pulse tubes through flow restrictors.

2. An integrated cryopump and 2 stage pulse tube refrigeration system comprising a cryopump, a compressor for a pulse tube refrigerator, a pulse tube refrigerator located within the vacuum chamber of the cryopump where the refrigerator comprises first and second stage regenerators connected to the compressor via an active valve assembly external to the cryopump vacuum chamber at one end and connected to the cold station of first and second stage pulse tubes, respectively, at the other end, and the hot ends of the pulse tubes are connected to each other through a buffer volume, the hot ends of the pulse tubes are integral to the cryopump vacuum chamber housing, the active valve assembly for the pulse tube refrigeration system is at the bottom or side of the cryopump vacuum chamber housing, the gas inlets for the pulse tube refrigeration system are at the bottom or back of the cryopump vacuum chamber housing, the cryopump inlet is on the side of the cryopump vacuum chamber housing, and a buffer volume is connected to the hot ends of the pulse tubes through flow restrictors.

3. The system of claim 1 where the gas inlets for the pulse tube refrigeration system are at the bottom of the cryopump housing.

4. The system of claim 1 where the gas inlets for the pulse tube refrigeration system are at the back of the cryopump housing.

5. The system of claim 1 also comprising a bypass line from the regenerator inlet line to the buffer volume and restrictors in the line.

6. The system of claim 1 also comprising a bypass line from the compressor inlet and outlet lines to the buffer volume and active valves in the line.

7. The system of claim 1 where the second stage regenerator comprises two separate sections.

8. The system of claim 1 where the hot ends of the regenerators extend through the cryopump vacuum chamber housing.

9. The system of claim 1 where the refrigerator is an inline refrigerator.

10. The system of claim 9 where the gas inlets for the pulse tube refrigeration system are at the bottom of the cryopump housing.

11. The system of claim 1 also comprising a bypass line from the compressor inlet and outlet lines to the buffer volume and active valves in the line.

12. The system of claim 9 also comprising bypass lines connected directly from the compressor through active valves to the hot ends of the pulse tubes.

13. The system of claim 9 where the second stage regenerator comprises two separate sections.

14. The system of claim 9 where at least one of the hot ends of the regenerators is integral to the cryopump vacuum chamber housing.

15. The system of claim 14 where the hot ends of the regenerators are integral to the cryopump vacuum chamber housing.

16. The system of claim 9 where the second stage regenerator comprises two separate parts.

17. An integrated cryopump and 2 stage pulse tube refrigeration system comprising a cryopump, a compressor for a pulse tube refrigerator, a pulse tube refrigerator located within the vacuum chamber of the cryopump where the refrigerator comprises a split body regenerator comprising a hot section and a cold section where the hot end of the hot section is connected to the compressor via a valve assembly external to the cryopump vacuum chamber and the cold end of the hot section is connected to the cold station of a first stage pulse tube and to the warm end of the cold section of the regenerator, the hot end of the first stage pulse tube is connected to the valve assembly, the hot end of the second stage pulse tube is connected to a buffer volume, and the hot ends of the pulse tubes are integral to the cryopump vacuum chamber housing.

* * * * *